US006053235A

United States Patent [19]

Ruffner, Sr.

[11] Patent Number: 6,053,235

[45] Date of Patent: Apr. 25, 2000

[54] CONVERTIBLE PANEL DOOR-SCREEN DOOR CLOSURE

[76] Inventor: Michael E. Ruffner, Sr., 1006 Beau Brummel Dr., Sleepy Hollow, Ill. 60118

[21] Appl. No.: 09/287,004

[22] Filed: Apr. 6, 1999

[51] Int. Cl.[7] ..... A47H 1/00

[52] U.S. Cl. ..... 160/89; 160/98; 160/113

[58] Field of Search ..... 160/89, 90, 98, 160/100, 101, 113, 190–193, 201; 49/69, 197, 198

[56] References Cited

U.S. PATENT DOCUMENTS

| | | | |
|---|---|---|---|
| 1,726,854 | 9/1929 | Mumford | 160/113 X |
| 4,356,668 | 11/1982 | Wagner | 160/113 X |
| 5,050,660 | 9/1991 | Bleichwehl et al. | 160/113 |
| 5,408,789 | 4/1995 | Plfeger | 160/113 X |

*Primary Examiner*—Daniel P. Stodola
*Assistant Examiner*—Hugh B. Thompson
*Attorney, Agent, or Firm*—Dillis V. Allen, Esq.

[57] ABSTRACT

A convertible panel door-screen door closure for residential garage doors or commercial doors having a torsion spring mechanism for balancing the panel door and a roll-up mechanism for the screen door. The roll-up mechanism is mounted beneath the torsion spring mechanism on header plates. Roller tracks for the panel door are mounted in spaced relation to the standard door jams by brackets and the tracks for the screen are mounted between the jams and the panel tracks on the same brackets. The screen door and panel door have the same position with respect to the jams, immediately to the rear of the jams, when in their down positions, and hence only one door may be in the down or closed position at any time.

24 Claims, 5 Drawing Sheets

CONVERTIBLE PANEL DOOR-SCREEN DOOR CLOSURE

BACKGROUND OF THE INVENTION

Screen doors for residential garage door openers have found a good deal of success in the last several decades because they permit the garage area to be used as an entertainment or work area without the nuisance of insects or foreign materials blowing in the breeze.

In order to explain the prior art and the present convertible closure, it is helpful at this early point of the description to provide a nomenclature for the spatial relation in overhead door technology. This nomenclature is generally derived from the viewpoint of the garage door installer, who generally is standing inside the garage facing the outside. Some installers may accept these definitions of directions and some may not, but they will hopefully be consistent in terms of the present description.

The direction toward the outside of the door opening is defined as the forward direction, and the direction from the opening toward the inside of the garage is defined as the rear direction. The direction, again when facing the opening from the inside of the garage, to the left of the left track and left header plate mechanism is referred to herein as outside, and the area to the right of the left track is referred to as the inner or inside, as defined herein, and the opposite is true with respect to the right track and right header assembly.

Furthermore, the garage door openings are usually, but not always, defined by a pair of spaced vertical jams, each commonly including several 2×6's bound together, and a horizontal header, usually a 2×6, positioned in a vertical plane across the top of the jams. The inside of the jams usually have a vertical strip of trim material, referred to as a stop, that seals against the forward surface of the panel door.

HPD International Inc. of Brookfield, Wis., manufactures a line of "Pest-Aside" screen doors. One of these mounts to the front surface(outside wall) of the garage door opening, which denigrates the architecture of the structure and also subjects it to deterioration due to exposure to the weather. The HPD company also manufactures an offset rolling screen door mounted at the rear of the door opening on tracks and a rolling mechanism mounted rearwardly from the overhead door track. Because of the substantial displacement of the roller mechanism and track assemblies from the jams, it is extremely difficult to seal this Pest-Aside door mechanism, and it occupies a significant amount of space within the building enclosure.

The Screen America Corporation manufactures a line of "Skeet'r Beat'r" rolling screen assemblies for residential garage doors. Several of these are forward mounting assemblies that mount to the outside wall of the garage, but S.A.C. does manufacture a third model with the screen roll assembly mounted beneath and forwardly of the header between the door opening jams. The track is mounted inside the door stops. This design again has the disadvantage that it takes up significant additional space within the door opening, and in fact reduces the vertical door clearance significantly and is, of course, subjected to outside elements because it is mounted forwardly of the panel door. In a fourth embodiment, the screen roller assembly is mounted in the position of the header, which requires that the header be removed, and the track again is mounted inside the stops, which subject the tracks to the outside elements.

The Dodge, et al., U.S. Pat. No. 778,228; the Forsyth, U.S. Pat. No. 839,282; the Drake, U.S. Pat. No. 2,015,993; the Wood, U.S. Pat. No. 1,015,413; the Claus, U.S. Pat. No. 1,958,695; the Doscher, U.S. Pat. No. 1,960,434; the Munson, U.S. Pat. No. 3,050,742; the Keegan, et al., U.S. Pat. No. 3,371,702, and the Lange, U.S. Pat. No. 4,651,797, all show various screening devices, some roll-ups—in connection with screening doors, and windows, but none in relation to overhead doors.

SUMMARY OF THE PRESENT INVENTION

In accordance with the present invention, a convertible panel door-screen door closure for a residential garage door or certain types of commercial doors is provided that may be either installed in new construction with the panel door assembly or which can also be easily retrofitted to existing panel door installations.

A conventional torsion spring mechanism is provided for balancing the panel door, and it is mounted in bearings in header plates extending inwardly from the top header. Drums are fixed to the torsion bar outside the header plates that drive vertical cables connected to outside lift bottom fixtures on the bottom panels of the doors to provide clearance for the screen and the screen track.

A roll-up mechanism is provided for the screen door and it, too, is mounted in bearings in the same header plates below the torsion spring mechanism for the panel door providing an extremely compact envelope for both assemblies. That is, the forward to rear envelope is greatly reduced over competitive designs.

Roller tracks for the panel door are mounted in rearwardly spaced relation to the door jams on standard brackets, and the tracks for the screen door are mounted between the jams and the panel tracks(on the rear of the jams and forwardly of the panel tracks) on the same brackets. The screen door and the panel door have the same position with respect to the jams, immediately to the rear of the jams, when in their down position, providing the minimum space envelope for the two doors, and hence, only one door may be in the down or closed position at one time.

Other objects and advantages of the present invention will appear more clearly from the following detailed description.

DETAILED DESCRIPTION OF THE PREFERRED EMBODIMENTS

Figure 1:
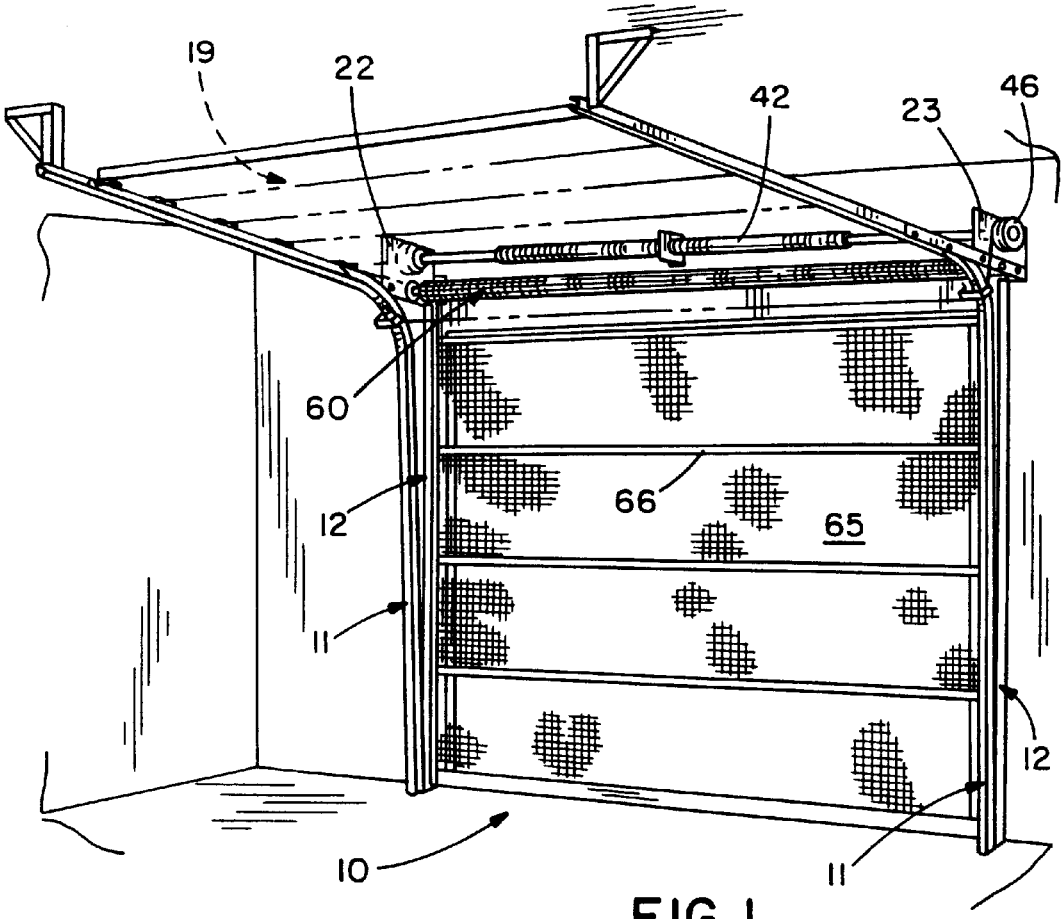
FIG. 1 is a perspective view of the present convertible panel door-screen door assembly viewed from the inside of the building.

Referring to the drawings and particularly FIGS. 1 to 8, a convertible panel door-screen door assembly 10 is illustrated consisting generally of a panel door mechanism 11(see FIGS. 3 and 4), and a screen door mechanism 12. An important aspect of the present invention is that the forward to rear positions(as defined above) of the screen door mechanism 12 is substantially the same as the forward and rear position of the panel door mechanism 11. More specifically, and as will appear hereinbelow, the screen door mechanism 12 occupies part of the forward portion of the envelope for the panel door mechanism 11.

Figure 6:
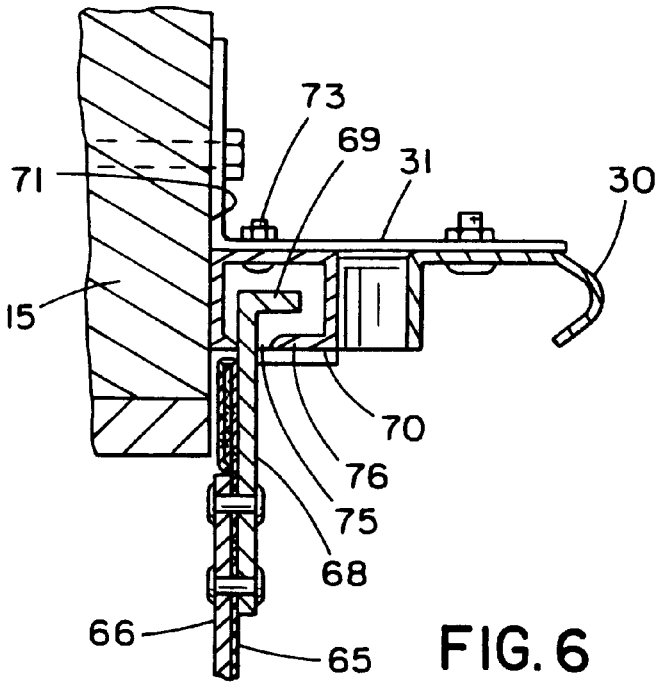
FIG. 6 is a fragmented top view of the right track assembly with the screen down.
Figure 7:
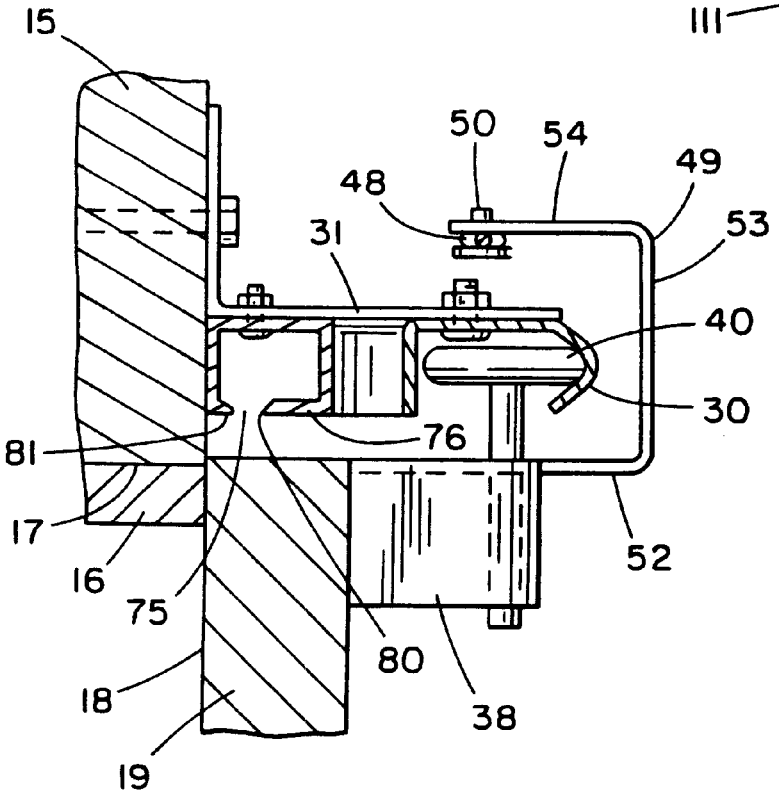
FIG. 7 is a fragmented top view of the right track assembly with the screen door up and the panel door down.

To more readily understand this relationship, reference is made to FIGS. 6 and 7, which are top views of the right track assembly. Most conventional garage doorways are framed by vertical jams 15 at the sides of the doorway opening, usually one or more 2×6's or 2×4's back to back with stops 16 fixed to inner surface 17 that form the seals for the forward surface 18 of the individual panels 19 in the panel door assembly 11. The garage door opening is framed at the top by a horizontal header 20, which conventionally includes one or more 2×6's back to back lying in vertical planes with their lower surfaces covered by trim strips, such as indicated at 21.

An important aspect of the present invention is that the panel door assembly 11 is largely, but not wholly, conventional so that the screen door assembly 12 can be easily retrofitted.

Figure 8:
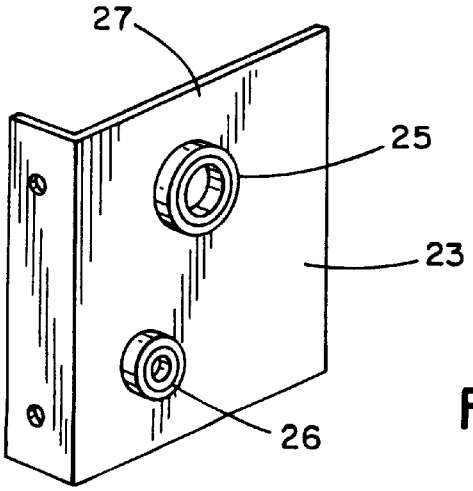
FIG. 8 is a perspective view of the right header plate.

L-shaped header plates 22 and 23 are bolted to the header and have a torsion spring assembly bearing 25 carried thereby and a screen roll-up bearing assembly 26 carried thereby below and slightly forwardly of the torsion spring bearing assembly 25. This significantly reduces the combined forward to rear space requirement for the torsion spring assembly and the screen roll-up assembly. Note that FIG. 8 depicts the right header plate portion 27 lying in a plane perpendicular to the header and extending in a direction rearwardly therefrom as defined herein.

The panel door assembly 11 includes a pair of conventional track assemblies 30, which are mirror images of one another, supported in a spaced relation rearwardly of the jams 15 by a plurality of brackets 31, also depicted in FIGS. 6 and 7. The tracks have a 90 degree curve portion 33 and a rearwardly extending horizontal portion 34 supported on the header plates by brackets 36 and suspended from the ceiling.

Figure 4:
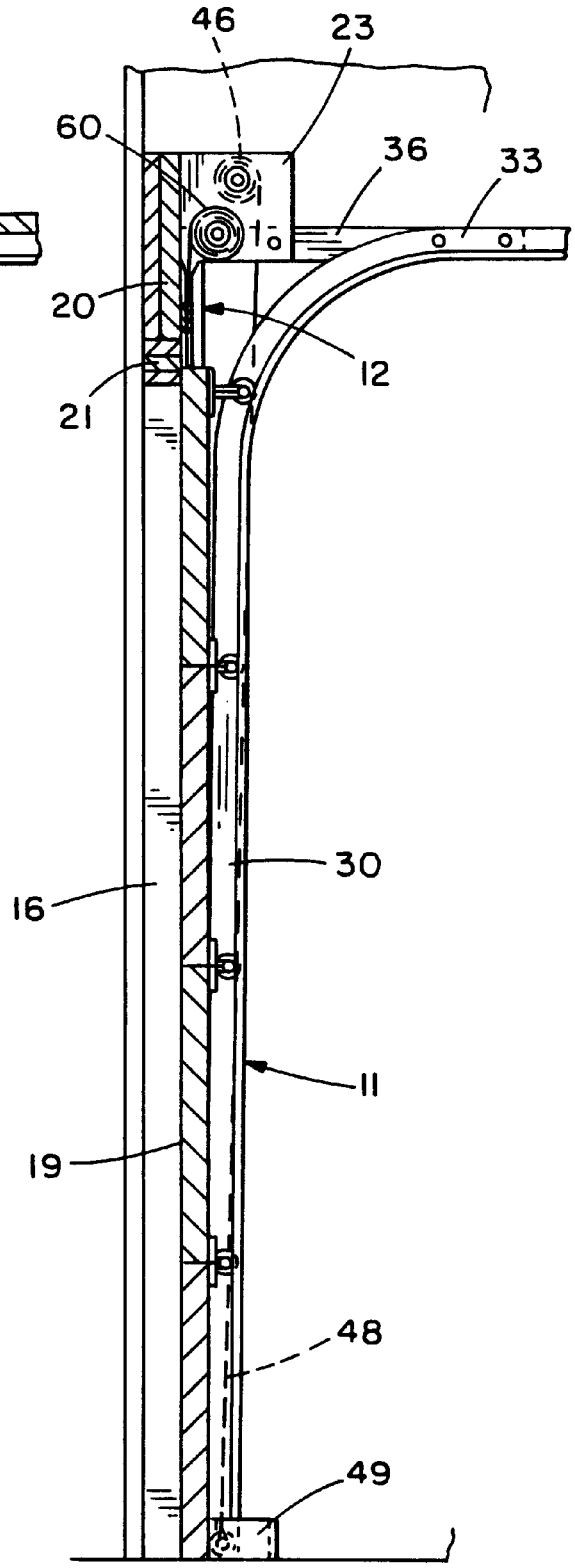
FIG. 4 is an inside view of the right track assembly similar to FIG. 3, with the panel door in its down position, and the screen door in its up position.
Figure 5:
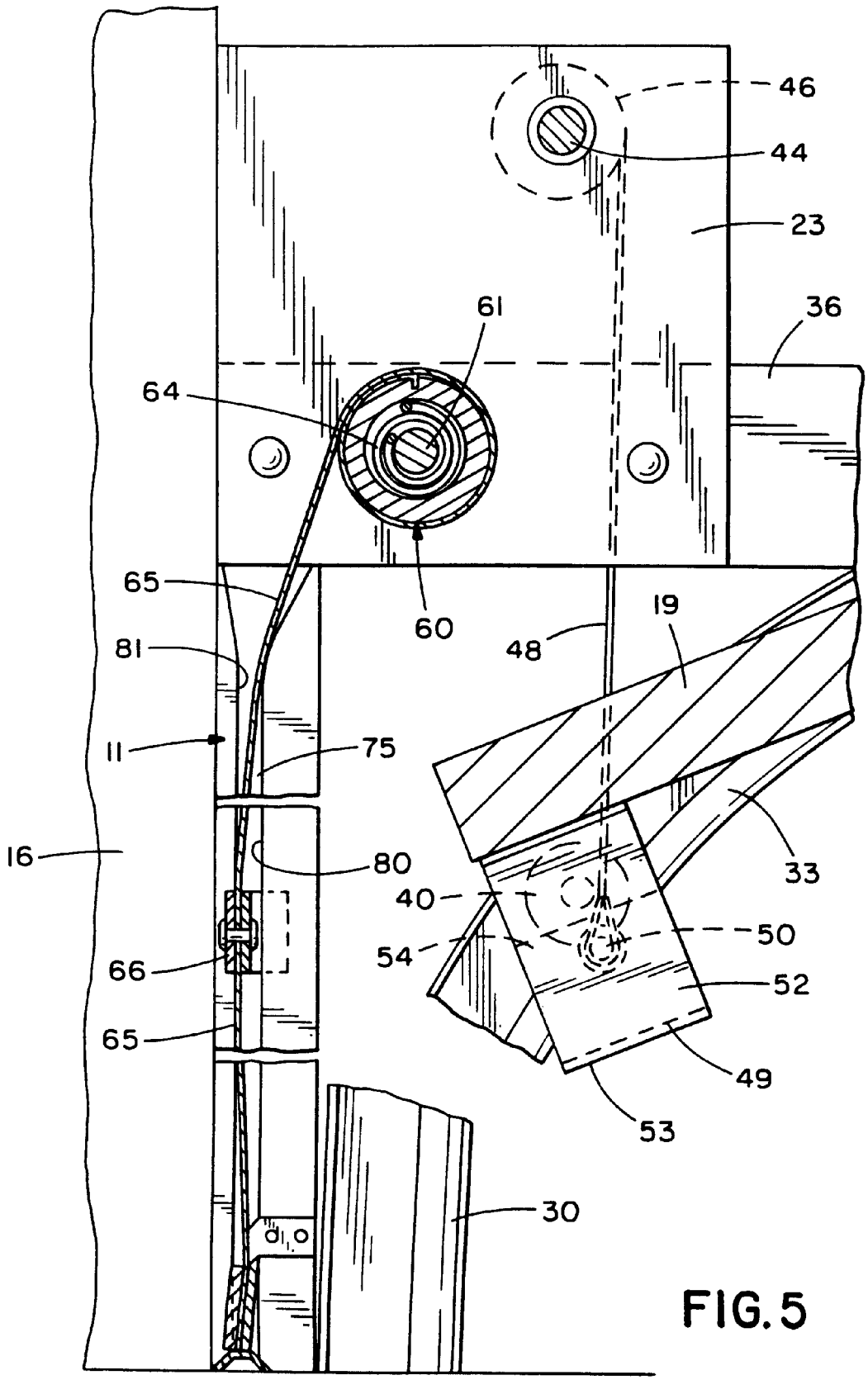
FIG. 5 is an enlarged fragmented inside view of the right track assembly similar to FIG. 3.

The door panels 19 have a plurality of brackets 38 on their rear surfaces flush with their outer edges carrying roller assemblies 40 that ride in tracks 30. A torsion spring assembly 42 has torsion bars 43 and 44 journaled in the head plate bearings 25, and they extend outwardly of the head plates 22 and 23, and are fixed to cable drums 46 located outside the header plate portions 27. The drums 46 coil and carry a cable 48 that are connected to an outside lip bottom fixture 49 shown in FIG. 7 by a fastener 50. Fixture 49, as seen in FIG. 5, is connected to the bottom inside surface of the bottom panel 19*a,* as seen in FIGS. 4 and 5, and extends around the roller track 30, as seen in FIG. 7. To do this, bracket 49 includes a rearwardly extending portion 52, and outwardly extending portion 53, and a forwardly directed portion 54 that carries the fastener 50 fixed to the lower end of the cable 48. The location of the drums 46 outside the header plates 22 and 23, the position of the cable 48 outside the brackets 31, and the construction of the fixture 49 to accommodate this geometry is an important aspect of the present invention because it frees the area forwardly of the roller track 30 for the screen door assembly 12.

The screen door assembly 12 includes a roll-up mechanism 60 having a central shaft 61 mounted in bearings 26 in the header plates 22 and 23. A torsion spring re-wind mechanism 64 is provided around shaft 61 to bias the screen door toward its retracted position. If desired, the roll-up mechanism 60 may be motorized with a remote control.

Figure 2:
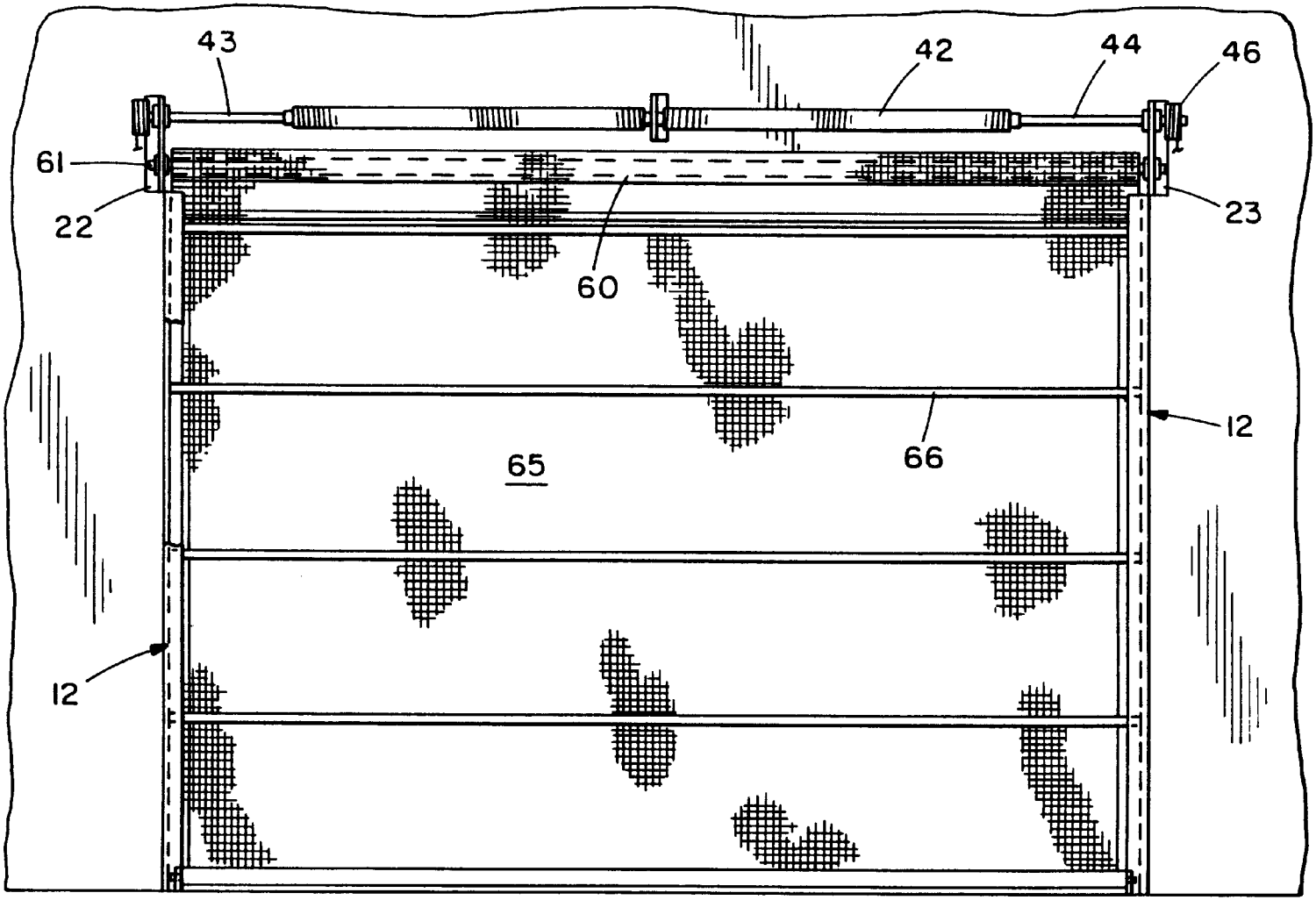
FIG. 2 is a rear plan view of the present convertible panel door-screen door assembly viewed from the inside of the building.
Figure 3:
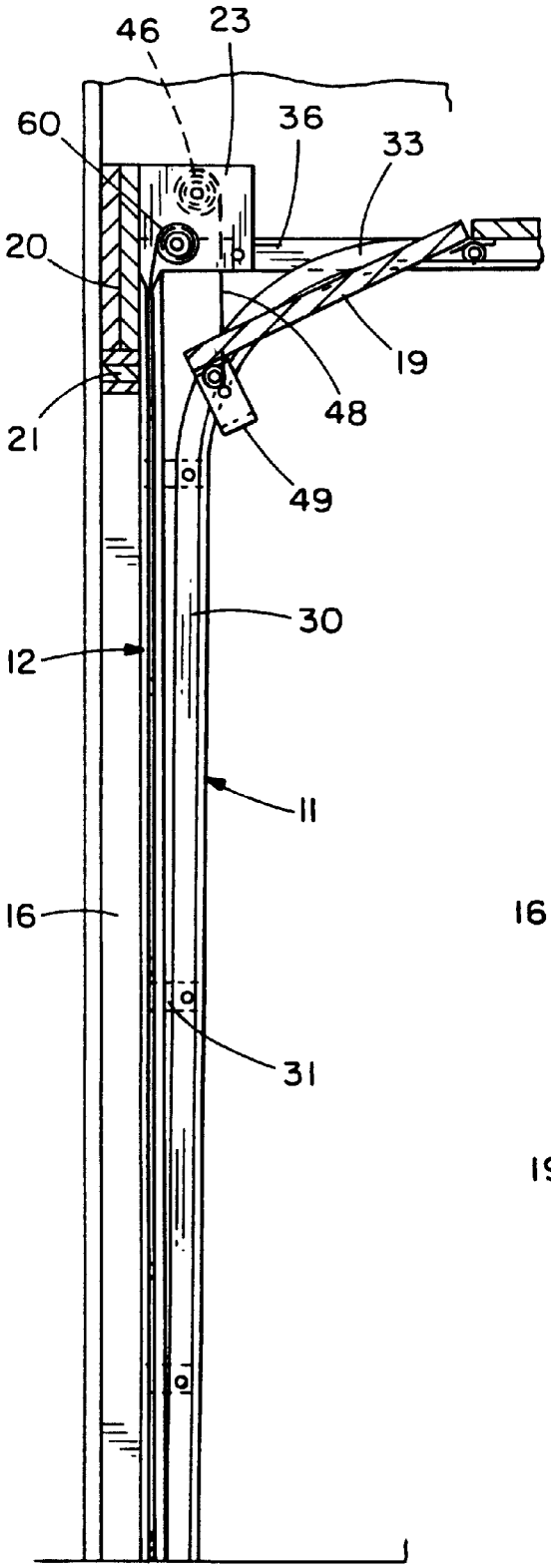
FIG. 3 is a left side view of the right track assembly illustrated in FIGS. 1 and 2, with the panel door in its up position, and the screen door in its down position.

A flexible screen 65, constructed of either metal or plastic mesh, is wound around roll-up mechanism 60 and has a plurality of 1"×⅛th" aluminum extrusion stiffening elements 66 in spaced parallel relation as seen in FIGS. 1 and 2.

The outer ends of the stiffening elements 66 carry L-shaped plastic or steel guides 68 with flanges 69 at their ends that ride in spaced screen door tracks 70.

As seen in FIG. 6, the screen door tracks 70 are mounted directly against rear surface 71 of the jams 15 on the roller brackets 31 by fasteners 73. This eliminates a duplication of brackets and positions the tracks 70 between the roller tracks 30 and the jams 15 vastly conserving space and reducing the required parts in the screen mechanism. The tracks 70 are generally rectangular in construction and have a vertical slot 75 in wall 76 for receiving the guides 68. As seen in FIG. 7, the ends 80 and 81 of the wall 76 adjacent slot 75 are tapered so that they provide a somewhat flexible seal against the screen guides 68.

Figure 9:
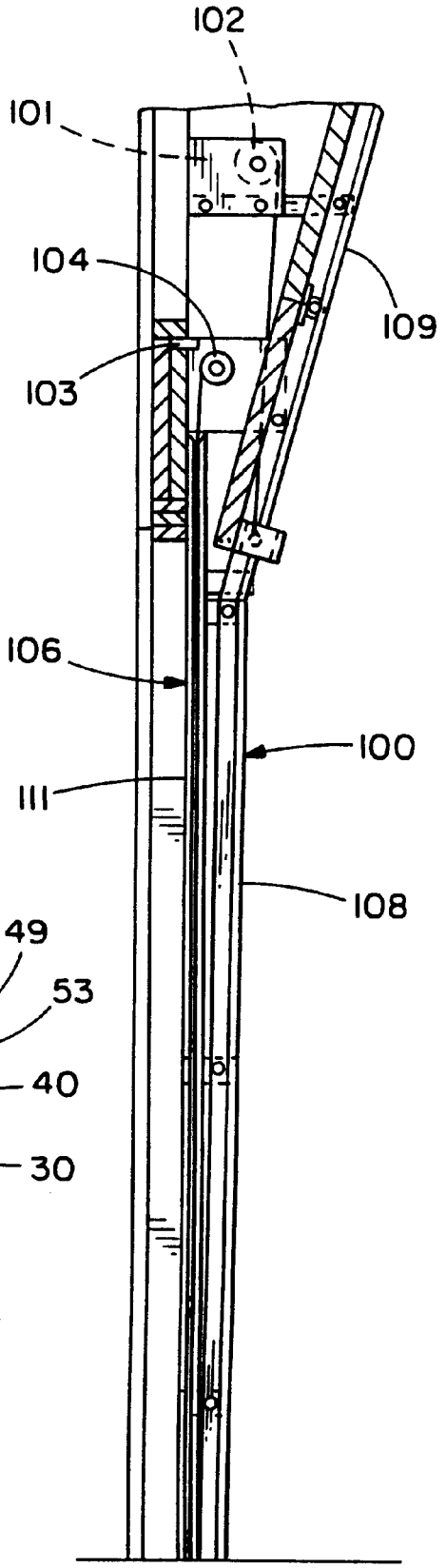
FIG. 9 is an inside view of the right track assembly of another embodiment adapted for high lift commercial doors.

In FIG. 9, a slightly modified form of the present invention is illustrated designed particularly for a high lift door assembly. High lift door assembly 100 includes a separate header plate 101 for torsion spring assembly 102 spaced above a lower header plate 103 for spring roll-up assembly 104, which forms part of the screen door assembly 106. The panel door assembly 100 includes a vertical track portion 108 and an angular, somewhat rearwardly extending second straight portion 109 bracketed to the upper header plate 101. The screen door assembly 106 includes a vertical track 111 that has the same location with respect to the track 108 and the door jams, as the embodiment in FIGS. 1 to 8. The principal difference in the FIG. 9 embodiment is that the vertical spacing between the torsion spring assembly 102 and the screen roll-up assembly 104 is greater than it is in the FIGS. 1 to 8 embodiment to accommodate the high lift door arrangement in the FIG. 9 embodiment; otherwise, the operation and elements are the same.

I claim:

1. A convertible screen-panel door assembly for closing an opening defined by a pair of vertical jams and a horizontal header near the top of the jams, comprising: a solid panel door for the opening, panel door track means for guiding the panel door to a first position closing the opening in a predetermined vertical plane at the rear of the jams, and to a second position spaced from the opening, a screen door for the opening, and screen door track means for guiding the screen door to a first position closing the opening in substantially the same plane as the predetermined vertical plane of the panel door preventing the panel door from moving to the first position when the screen door is in the first position, and to a second position spaced from the opening.

2. A convertible screen-panel door assembly as defined in claim 1, wherein the screen track means is mounted between the panel door track means and the jams.

3. A convertible screen-panel door assembly as defined in claim 2, wherein the screen track means includes two tracks adjacent the two jams each having a generally rectangular cross-section, said screen door including a plurality of guides slidable in the tracks, said tracks having integral sealing means engaging the guides to reduce foreign material from passing to the rear of the opening.

4. A convertible screen-panel door assembly as defined in claim 3, wherein the screen track means have an opening for receiving the guides, said integral sealing means being defined by flexible lips that seal against the guides.

5. A convertible screen-panel door assembly as defined in claim 1, a pair of spaced header plates mounted near the header and extending generally rearwardly therefrom, a torsion mechanism for the panel door mounted in the header plates, and a roll-up mechanism for the screen door mounted in the header plates, the roll-up mechanism for the screen door being mounted in the header plates below the torsion mechanism.

6. A convertible screen-panel door assembly as defined in claim 1, including a pair of spaced header plates mounted at the opening near the header, a torsion mechanism for the panel door mounted in the header plates including a pair of cable pulleys mounted on the side of the header plates opposite the panel door to provide clearance for the screen track means and screen door.

7. A convertible screen-panel door assembly as defined in claim 1, including means for mounting the screen track means on the rear side of the jams.

8. A convertible screen-panel door assembly as defined in claim 7, including a plurality of brackets connected to the jams for supporting the panel door track means rearwardly from the jams, said screen track means being supported on the panel door track means brackets.

9. A convertible screen-panel door assembly for closing an opening defined by a pair of vertical jams and a horizontal header near the top of the jams, comprising: a solid panel door for the opening, panel door track means for guiding the panel door to a first position closing the opening in a predetermined vertical plane at the rear of the jams, and to a second position spaced from the opening, a screen door for the opening, and screen door track means for guiding the screen door to a first position closing the opening, and to a second position spaced from the opening, a pair of spaced header plates mounted near the header and extending generally rearwardly therefrom, a torsion mechanism for the panel door mounted in the header plates about a first axis, and a roll-up mechanism for the screen door mounted in the header plates, the roll-up mechanism for the screen door being mounted in the header plates below the torsion mechanism and forwardly of the torsion mechanism axis, said screen door in the first position lying in the same plane as the panel door in its first position.

10. A convertible screen-panel door assembly as defined in claim 9, wherein the screen door track means is mounted between the panel door track means and the jams.

11. A convertible screen-panel door assembly as defined in claim 9, wherein the screen door track means includes two screen tracks adjacent the two jams each having a generally rectangular cross-section, said screen door including a plurality of guides slidable in the tracks, said screen tracks having integral sealing means engaging the guides to reduce foreign material from passing to the rear of the opening.

12. A convertible screen-panel door assembly as defined in claim 9, wherein the screen door track means have an opening for receiving the guides, said integral sealing means being defined by flexible lips that seal against the guides.

13. A convertible screen-panel door assembly for closing an opening defined by a pair of vertical jams and a horizontal header near the top of the jams, comprising: a solid panel door for the opening, panel door track means for guiding the panel door to a first position closing the opening in a predetermined vertical plane at the rear of the jams, and to a second position spaced from the opening, a screen door for the opening, and screen door track means for guiding the screen door to a first position closing the opening, and to a second position spaced from the opening, a pair of spaced header plates mounted at the opening near the header, a torsion mechanism for the panel door mounted in the header plates including a pair of cable pulleys mounted on the side of the header plates opposite the panel door to provide clearance for the screen track means and screen door, and panel door cables carried on the cable pulleys and extending downwardly outside the header plates and connected to panel door mounted brackets, said panel door cables extending in substantially the same plane as, but not interfering with, the screen door track means or the screen door, said screen door in the first position preventing movement of the panel door to its first position.

14. A convertible screen-panel door assembly as defined in claim 13, wherein the screen track means is mounted between the panel door track means and the opening jams.

15. A convertible screen-panel door assembly as defined in claim 13, wherein the screen track means includes two tracks adjacent the two jams each having a generally rectangular cross-section, said screen door including a plurality of guides slidable in the tracks, said tracks having integral sealing means engaging the guides to reduce foreign material from passing to the rear of the opening.

16. A convertible screen-panel door assembly as defined in claim 13, wherein the tracks have an opening for receiving the guides defined by flexible lips that seal against the guides.

17. A convertible screen-panel door assembly as defined in claim 13, including means for mounting the screen track means on the rear side of the jams.

18. A convertible screen-panel door assembly as defined in claim 13, including a plurality of brackets connected to the jams for supporting the panel door track means rearwardly from the jams, said screen track means being supported on the panel door track means brackets.

19. A convertible screen-panel door assembly for closing an opening defined by a pair of vertical jams and a horizontal header near the top of the jams, comprising: a solid panel door for the opening, panel door track means for guiding the panel door to a first position closing the opening in a predetermined vertical plane at the rear of the jams, and to a second position spaced from the opening, a screen door for the opening, and screen door track means for guiding the screen door to a first position closing the opening, and to a second position spaced from the opening, and means mounting the screen door track means on the rear of the opening jams and forwardly of the panel door track means, said screen door in the first position lying in the same plane as the panel door in its first position.

20. A convertible screen-panel door assembly as defined in claim 19, wherein the means mounting the screen track means at the rear of the jams includes mounting the screen track means between the panel door track means and the jams.

21. A convertible screen-panel door assembly as defined in claim 19, including a plurality of brackets connected to the jams for supporting the panel door track means rearwardly from the jams, said screen track means being supported on the panel door track means brackets.

22. A convertible screen-panel door assembly as defined in claim 19, wherein the screen track means includes two tracks adjacent the two jams each having a generally rectangular cross-section, said screen door including a plurality of guides slidable in the tracks, said tracks having integral sealing means engaging the guides to reduce foreign material from passing to the rear of the opening.

23. A convertible screen-panel door assembly as defined in claim 19, a pair of spaced header plates mounted near the header and extending generally rearwardly therefrom, a torsion mechanism for the panel door mounted in the header plates, and a roll-up mechanism for the screen door mounted in the header plates, the roll-up mechanism for the screen door being mounted in the header plates below the torsion mechanism.

24. A convertible screen-panel door assembly as defined in claim 19, a pair of spaced header plates mounted at the opening near the header, and a torsion mechanism for the panel door mounted in the header plates including a pair of cable pulleys mounted on the side of the header plates opposite the panel door to provide clearance for the screen track means and screen door.

* * * * *